US006543141B1

(12) United States Patent
Biehl

(10) Patent No.: US 6,543,141 B1
(45) Date of Patent: Apr. 8, 2003

(54) SAFETY RULER AND GUIDE FOR ROTARY CUTTERS

(76) Inventor: Shirley Biehl, 11426 S. US 231, Dale, IN (US) 61853

( * ) Notice: Subject to any disclaimer, the term of this patent is extended or adjusted under 35 U.S.C. 154(b) by 0 days.

(21) Appl. No.: 09/888,782

(22) Filed: Jun. 26, 2001

Related U.S. Application Data

(60) Provisional application No. 60/220,089, filed on Jul. 21, 2000.

(51) Int. Cl.[7] ..... B43L 7/00

(52) U.S. Cl. ..... 30/289; 33/483; 83/745; D19/35

(58) Field of Search ..... 30/289; 33/483, 33/484, 489, 492; 83/745, 755; D19/35, 37; D10/70, 71

(56) References Cited

U.S. PATENT DOCUMENTS

D25,261 S * 3/1896 Wilson ..... 33/489

4,349,966 A * 9/1982 Marino et al. ..... 33/489

* cited by examiner

*Primary Examiner*—Douglas D. Watts
(74) *Attorney, Agent, or Firm*—Gary K. Price

(57) ABSTRACT

A safety ruler and guide used with a rotary cutter or the cutting tool for cutting fabric, the ruler designed to protect a user's first hand when holding the ruler on top of the fabric while the second hand is cutting the fabric with the cutting tool. The ruler has a vertical guard mounted exactly upright to a base guide, dividing the base equally into a first side and a second side. Each first side and second side display grids, ruler measurements and measuring scale to enable a right or left handed user to properly read and measure length and width of the fabric being cut. The first side and second side also include a ruler edge for measuring the length of fabric being cut, and serving as a guide and cutting edge for the rotary cutter. The user may then cut the fabric using the cutting tool without the cutting tool or fabric moving during cutting. In the event the cutting tool slips while cutting, the hand holding and applying pressure to the ruler is protected by the vertical guard.

7 Claims, 7 Drawing Sheets

SAFETY RULER AND GUIDE FOR ROTARY CUTTERS

CROSS REFERENCES TO RELATED APPLICATIONS

U.S. Provisional Application for Patent No. 60/220,089, filed Jul. 21, 2000, with title, "Safety Ruler and Guide for Rotary Cutters" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates to a safety ruler and guide used with a rotary cutter for cutting fabric. The safety ruler and guide comprising a base guide, and a vertical guard, said base guide having a first ruler edge, a second ruler edge, and a hook clearance. The safety ruler and guide allowing the user to apply stabilizing pressure to the ruler with a first hand and using his or her opposite hand to cut the fabric with the rotary cutter or other cutting tool, and further designed to protect the user's said first hand from injuries caused by the rotary cutter slipping over the cutting edge of the ruler during use.

2. Brief Description of Prior Art

A ruler is commonly used when cutting single or multiple layers of fabric. The ruler is generally placed on the fabric and held with one hand while the other hand cuts the fabric with a rotary cutter. It is intended that sufficient pressure be placed on the ruler, and fabric, to prevent the fabric from creeping during cutting. Should the rotary cutter slip while cutting, the hand holding the ruler is unprotected from the rotary cutter slipping over the cutting edge of the ruler causing injury. Some existing rulers have a fence or wall next or near the cutting edge in an effort to prevent such injury.

U.S. Pat. No. 5,842,402 to Collier, includes a base with a cutting edge, a hand rest, and a vertical wall, where the said base has a total width in the range of 5 to 8 inches, and said vertical wall having a height in the range of 2 to 6 inches and being the same length as the cutting edge, and being situated approximately 1 inch from the cutting edge of the ruler. As such, the said hand rest in Collier has a width in the range of 4 to 7 inches. The resulting design allows the user to apply only limited pressure to the ruler and fabric during use causing thick, slippery and slick fabric to creep during cutting. Further, the top portion of the vertical wall in Collier includes an approximate 1 inch lip. While a hand is likely able to fit between the lip portion and base in order to apply pressure to the ruler, a handicapped person who cannot use his or her hand, but instead use a forearm, for example, would not be able to use the ruler described in Collier due to said lip.

Further, existing rulers are generally designed for right-handed people. Left-handed people, who use their left hand for cutting, would have to turn the prior art rulers upside down. Rulers often display measuring scales. As such, when the ruler is turned upside down, the measuring scale is also displayed upside down. Also, existing rulers when in place, may measure the length of fabric being cut, but not the width.

As will be seen from the subsequent description, the preferred embodiments of the present invention overcome these and other shortcomings of prior art.

SUMMARY OF THE INVENTION

The present invention is an apparatus that is a safety ruler and guide used for cutting fabrics with a rotary cutter or other cutting tool, comprising a base guide and a vertical guard, said base guide having a first ruler edge, a second ruler edge, and a hook clearance. The safety ruler and guide allowing the user to apply stabilizing pressure to the ruler with a first hand and using his or her opposite hand to cut the fabric with the rotary cutter or other cutting tool. The vertical guard is exactly upright to the base guide, thereby forming a protective guard between the rotary cutter and user's hand holding the ruler, that will protect the user's hand during the cutting operation. The hook clearance will accept a wall hook for storing the ruler.

DESCRIPTION OF THE PREFERRED EMBODIMENTS

Figure 1:
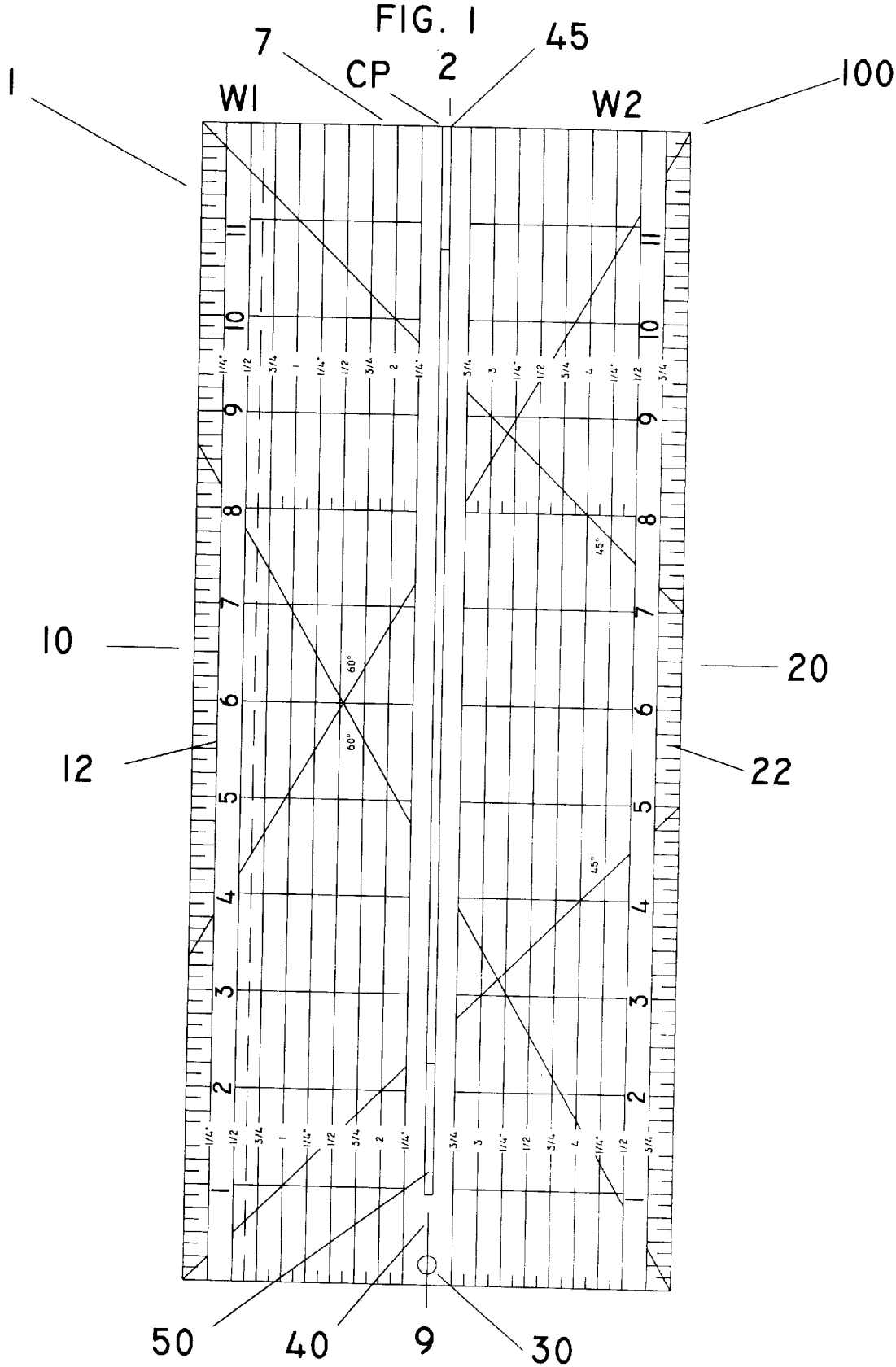
FIG. 1 illustrates the preferred embodiment of the present invention, a safety ruler and guide for rotary cutters.

FIG. 1 illustrates the preferred embodiment of the present invention, an apparatus which is a safety ruler and guide 100 that is used for cutting fabrics with a rotary cutter or other cutting tool, and further useful for guiding the cutting tool when cutting fabrics, comprising a base guide 1, a vertical guard 2, and a hook clearance 30. The base guide 1 further comprising a first edge 10, a second edge 20, a base first end 7, and a base opposite end 9. The first edge 10 of the base guide 1 having a first ruler/guide edge 12 which serves as a measuring scale for measuring the length of fabric being cut, and also serves as a guide and cutting edge for the rotary cutter. The second edge 20 of the base guide 1 having a second ruler/guide edge 22 which, like the first ruler/guide edge 12, serves as a measuring scale for measuring the length of fabric being cut, and serves as a guide and cutting edge for the rotary cutter.

Figure 2:
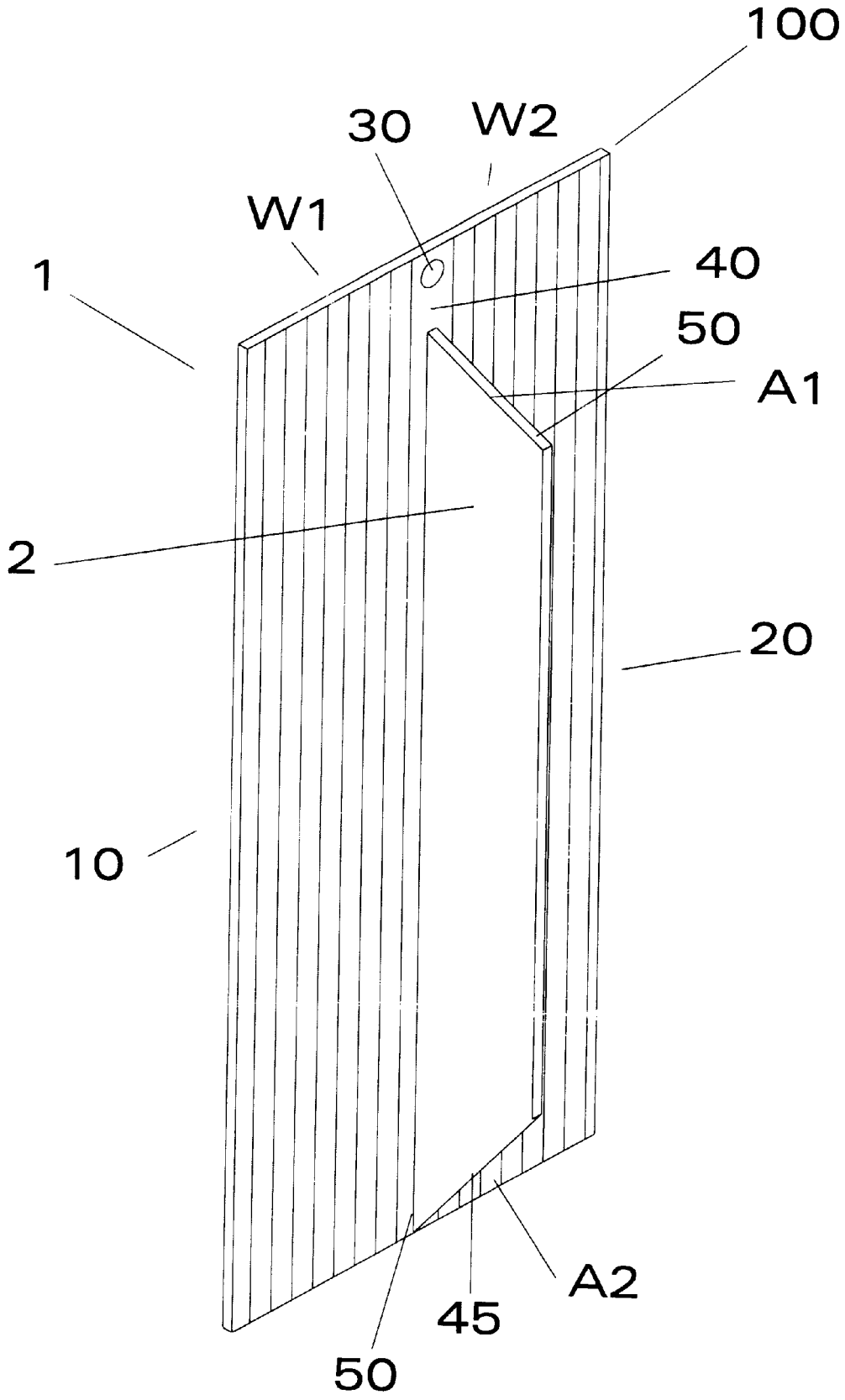
FIG. 2 illustrates a front view of the safety ruler and guide for rotary cutters.
Figure 3:
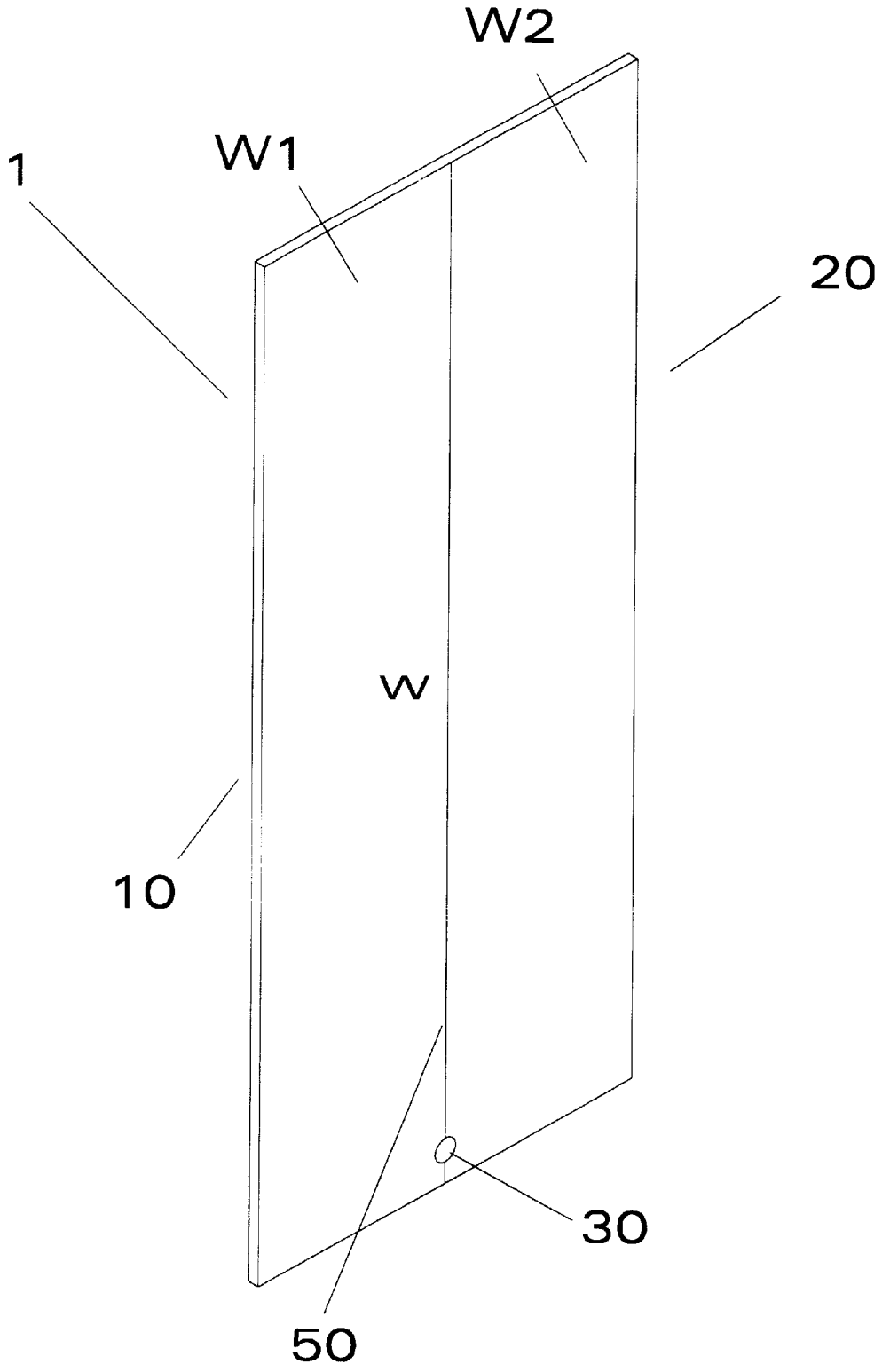
FIG. 3 is a view of the base guide.

The vertical guard 2 comprising a guard first end 45 and a guard opposite end 50. As shown in FIG. 2, said vertical guard 2 is mounted exactly upright to the base guide 1, and, as shown in FIGS. 1 and 3, partitions or divides the width of the base guide 1 in approximate equal sides referred to as first side W1 and second side W2. Sides W1 and W2 display grids, ruler measurements and measuring scale to enable a right or left handed user to properly read and measure length and width of the fabric being cut during use. Further, both said sides W1 and W2 having adequate width as discussed below, to allow for the user to apply adequate pressure to the ruler 100 during use.

The vertical guard 2 is mounted exactly upright to the base guide 1. The guard first end 45 of the vertical guard 2 is attached on the same plane at the approximate center point designated as "CP" in FIG. 1, of the base first end 7 of the base guide 1. The guard opposite end 50 of the vertical guard 2 extends to within approximately 1 inch from the base opposite end 9 of the base guide 1, leaving a space clearance 40 between the ends 50 and 9. The hook clearance 30 is located in the space clearance 40, between the ends 50 and 9 as shown in FIGS. 1 and 2.

Figure 4:
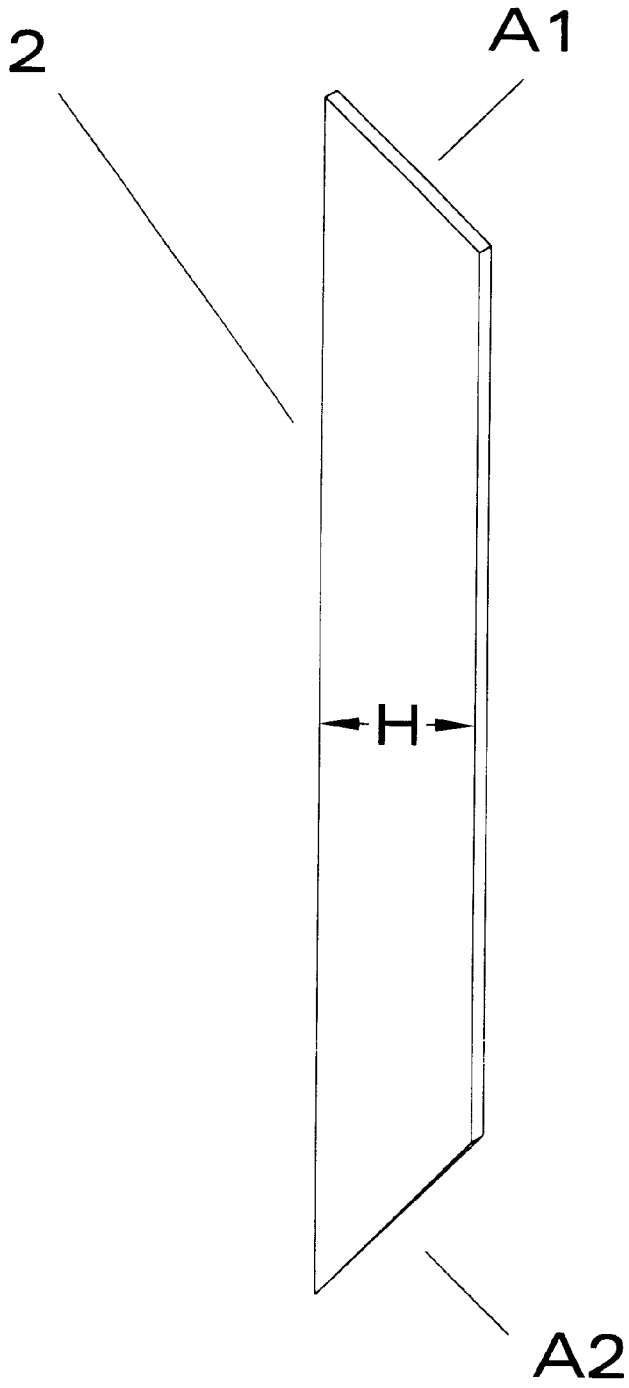
FIG. 4 is a view of the vertical guard.

As shown in FIGS. 2 and 4, the ends 45 and 50 of the vertical guard 2 have 45° angles A1 and A2, respectively. Angles A1 and A2 help eliminate sharp corners on the ends 45 and 50 of the vertical guard 2. This not only protects the user from possible injury, but further protects the vertical guard 2 from cracking or breaking if dropped.

Figure 5:
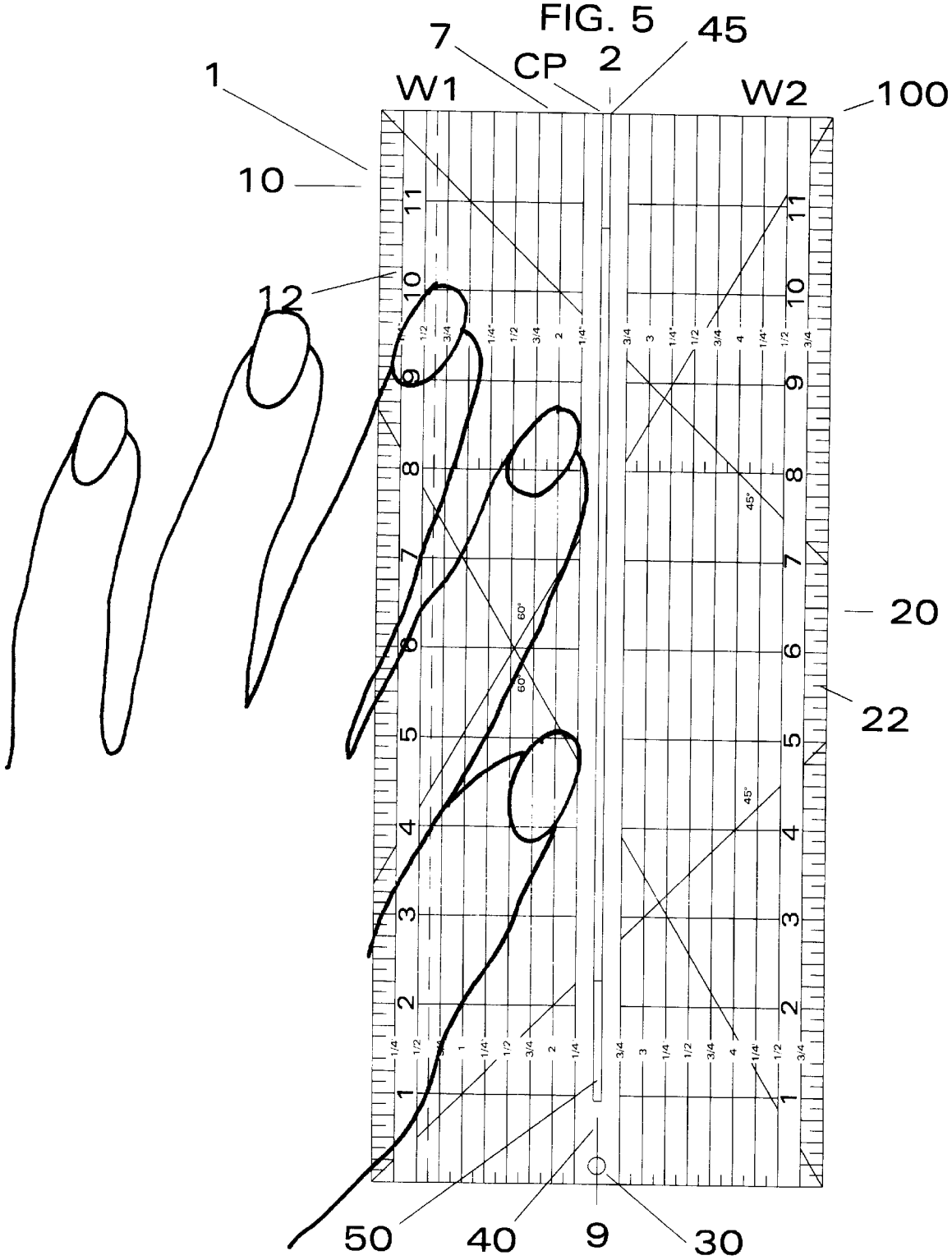
FIGS. 5, 6 and 7 illustrate the preferred embodiment of the present invention during use.

The height, referred to in FIG. 4 as "H", of the vertical guard 2 is 1½ inches in order to provide adequate protection to the user's hand while holding the ruler 100 during use. Referring to FIG. 3, the width "W" of the base guide 1 is 5 inches. As such, the width of the first side W1 is approximately 2½ inches, and the width of the second side W2 is approximately 2½ inches. Sides W1 and W2 enable the user sufficient width to apply adequate pressure to the ruler 100 and the fabric during use. When in use, the user places the ruler 100 on the fabric (not shown) to be cut. Referring to FIG. 5, if the user is right-handed, the user applies pressure to the ruler 100 and fabric by placing a portion of his or her left hand on the first side W1, the "hand rest side" for this example, with the left hand's thumb and index finger touching the vertical guard 2 for control of the ruler 100, and the remaining portion of the user's hand, namely the ring finger and little finger of the user's left hand on the fabric for added stabilization. The user would then cut the fabric with his or her right hand using the rotary cutter or other cutting tool as shown in FIG. 7, and using said second ruler edge 22 as a guide and cutting edge for the rotary cutter. Likewise, referring to FIG. 6, if the user is left-handed, the user places a portion of his or her right hand on the second side W2, the "hand rest side" for this example, with the right hand's thumb and index finger touching the vertical guard 2 for control of the ruler 100, and the remaining portion of the user's hand, namely the ring finger and little finger of his or her right hand on the fabric for added stabilization. The user would then cut the fabric with his or her left hand using the rotary cutter or other cutting tool as shown in FIG. 7, and using said first ruler edge 12 as a guide and cutting edge for the rotary cutter.

Figure 6:
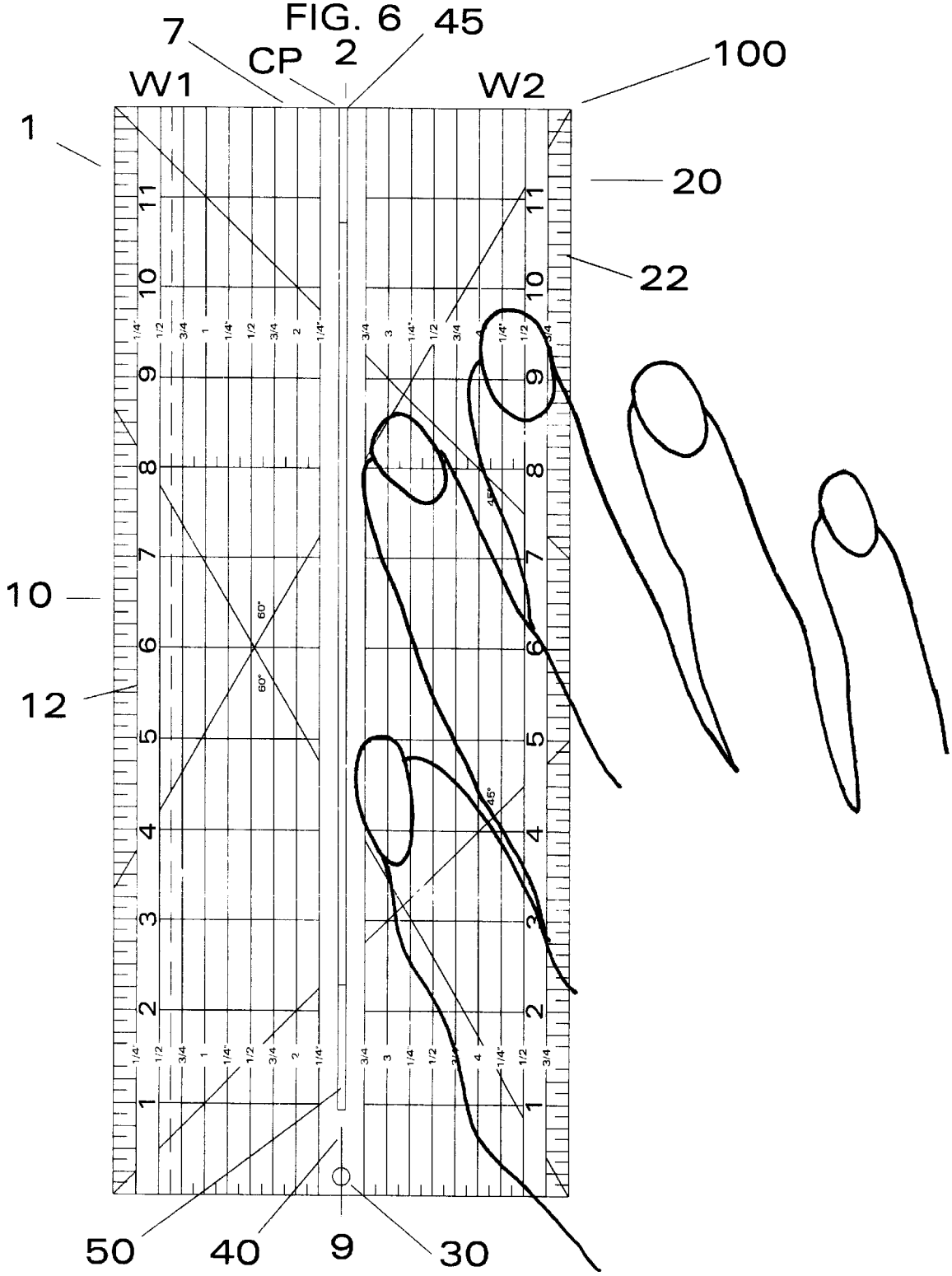
Figure 7:
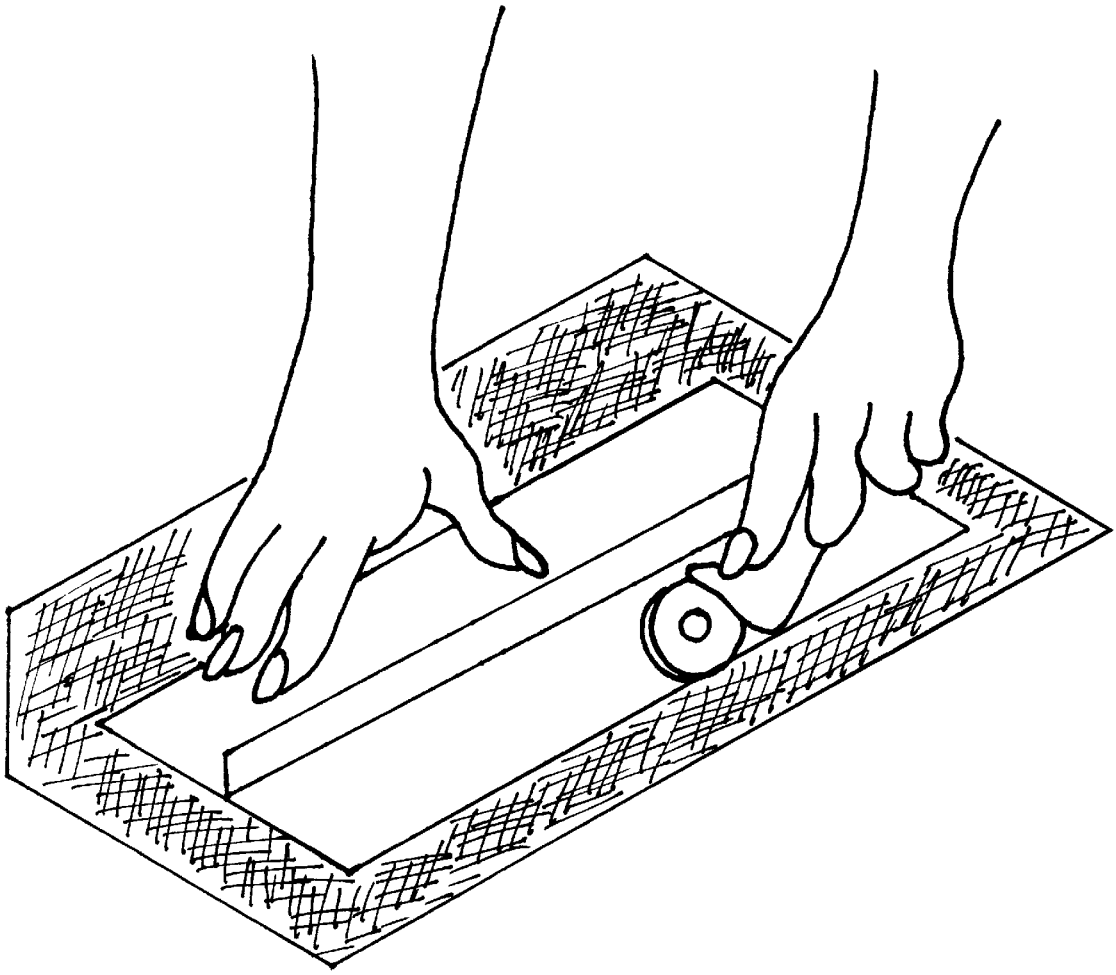

By resting the ring finger and little finger of the holding hand on the fabric, while the remaining hand rests on the said hand rest side of the base guide 1 and against the vertical guard 2 as described above, the user's portion of hand positioned on the hand rest side, as shown in FIGS. 5 and 6, is able to stabilize the ruler 100 and hold the fabric in place with less pressure exerted. The user may then cut the fabric using the rotary cutter without the fabric creeping during cutting.

Sides W1 and W2 enable the user sufficient width to accept the user's holding hand to apply adequate pressure to the ruler 100 during use, while also applying pressure to the fabric being cut in order to prevent the fabric from creeping during cutting. Further, and importantly, the sides W1 and W2 width allows the user to apply such pressure while positioning the user's holding hand immediately next to the vertical guard 2 for protection. In the event the rotary cutter slips while cutting, the hand holding and applying pressure to the ruler 100 is protected by the vertical guard 2, and the distance between the ruler edge 12 or 20 and the position of the user's hand on the base guide 1 holding and applying pressure to the ruler 100 during use. The likelihood of the rotary cutter injuring the user's hand hold and applying pressure to the ruler 100 is minimal.

It should be noted that the above discussion refers to a user's hand as applying pressure to the ruler 100 during use. The present embodiment would be equally effective for a handicapped person who could not use his or her hand to apply pressure, but instead use a forearm, for example. Further, while the description contained herein is for a rotary cutter tool, it should be obvious to those skilled in the art that the ruler 100 may be used for example, as a marking ruler to mark patterns and fabric. Further, it should be obvious that the ruler 100 may be used for not only cutting and measuring fabric, but also paper and other materials as well.

In the preferred embodiment of the present invention, the material of construction of the base guide 1 and vertical guard 2 are preferably of acrylic or appropriate acrylic polymer materials.

Although the description above contains many specificities, these should not be construed as limiting the scope of the invention but is merely providing illustrations of some of the presently preferred embodiments of this invention.

Thus, the scope of the invention should be determined by the appended claims and their legal equivalence, rather than by the examples given.

I claim:

1. An apparatus which is a safety ruler and guide used when cutting material, the apparatus designed to protect a user's first hand when holding the apparatus on top of the material while the second hand is cutting the material with a rotary cutter or other cutting tool, comprising;

a base guide;

a vertical guard mounted exactly upright to the base guide;

a space clearance, and a hook clearance;

wherein the base guide further comprising a first edge and a second edge for guiding the cutting tool when cutting the material, a first based end, and an opposite base end;

wherein the vertical guard further comprising a guard first end and a guard opposite end;

wherein the guard first end is attached on the same plane as the base first end of the base guide, and wherein the guard opposite end extends to within approximately one inch from the base opposite end of the base guide, forming the space clearance between the guard opposite end and the base opposite end.

2. The apparatus of claim 1, wherein the vertical guard partitions the width of the base guide forming a first side and a second side;

whereby a portion of the user's first hand rests on either the first side or second side and immediately next to the vertical guard, and a remaining portion of said user's first hand rests on the material so that neither the apparatus or material moves during cutting.

3. The apparatus of claim 2, wherein the width of said first side and second side are equal.

4. The apparatus of claim 2, wherein the said first side and second side each display grids, ruler measurements and measuring scales for measuring the material to be cut.

5. The apparatus of claim 1, wherein the height of the vertical guard is 1½ inches to provide adequate protection to the first hand while holding the apparatus during use.

6. The apparatus of claim 2, wherein the width of the first side is approximately 2½ inches and the width of the second side is approximately 2½ inches.

7. The apparatus of claim 1, wherein the vertical guard protects the first hand from the cutting tool, should the cutting tool slip while cutting.

* * * * *